US006199806B1

(12) United States Patent
Sauer et al.

(10) Patent No.: US 6,199,806 B1
(45) Date of Patent: Mar. 13, 2001

(54) LONGITUDINALLY DISPLACEABLE COLUMN

(75) Inventors: Rainer Sauer, Anschau; Axel Knopp, Eitelborn, both of (DE)

(73) Assignee: Stabilus GmbH, Koblenz (DE)

( * ) Notice: Subject to any disclaimer, the term of this patent is extended or adjusted under 35 U.S.C. 154(b) by 0 days.

(21) Appl. No.: 09/260,291

(22) Filed: Mar. 2, 1999

(30) Foreign Application Priority Data

Mar. 5, 1998 (DE) ..... 198 09 389

(51) Int. Cl.[7] ..... F16M 11/00

(52) U.S. Cl. ..... 248/161; 248/404; 248/631

(58) Field of Search ..... 248/161, 162.1, 248/404, 405, 406.1, 406.2, 631, 414, 415, 416, 575, 599; 267/64.12; 297/345, 349, 344.18, 344.19; 188/300, 322.16

(56) References Cited

U.S. PATENT DOCUMENTS

| | | | | |
|---|---|---|---|---|
| 5,120,011 | | 6/1992 | Mintgen et al. . | |
| 5,269,398 | * | 12/1993 | Wolf et al. | 188/300 |
| 5,702,083 | * | 12/1997 | Lai | 248/404 |
| 5,740,997 | * | 4/1998 | Van Wieran | 248/404 |
| 5,979,845 | * | 11/1999 | Battey et al. | 248/161 |
| 5,988,605 | * | 11/1999 | Weisser et al. | 267/64.12 |
| 5,992,815 | * | 11/1999 | Metzdorf et al. | 248/631 |
| 6,007,044 | * | 12/1999 | Harrer | 248/631 |
| 6,056,251 | * | 5/2000 | Knopp et al. | 248/161 |

FOREIGN PATENT DOCUMENTS

| | | |
|---|---|---|
| 76 23 283 | 1/1977 | (DE) . |
| 33 37 598 | 5/1984 | (DE) . |
| 41 29 089 | 3/1993 | (DE) . |
| 296 08 147 | 9/1996 | (DE) . |
| 512 434 A1 | 11/1992 | (EP) . |
| WO 96/03065 | 2/1996 | (WO) . |

* cited by examiner

*Primary Examiner*—Anita M. King
*Assistant Examiner*—Tan Le
(74) *Attorney, Agent, or Firm*—Baker Botts L.L.P.

(57) ABSTRACT

A longitudinally displaceable column includes a longitudinal adjusting unit which is supported on a base plate of a vertical tube. The adjusting unit has a rod that receives an axial bearing, which is interposed between the rod and the base plate so that the rod is rotatable relative to the base plate. The axial bearing is a sliding bearing that has a sliding member.

13 Claims, 3 Drawing Sheets

LONGITUDINALLY DISPLACEABLE COLUMN

BACKGROUND OF THE INVENTION

1. Field of the Invention

The present invention relates to a longitudinally displaceable column of the type in which a longitudinal adjusting unit is supported on a base plate of a vertical support tube and, in particular, in which a rod of the adjusting unit receives an axial bearing that is interposed between the rod and the base plate to enable the rod to rotate relative to the base plate.

2. The Prior Art

DE 41 29 089 A1 discloses a longitudinally displaceable column for height adjustment of chairs, tables or the like, having a vertical tube with a longitudinal pneumatic or hydropneumatic adjusting unit arranged therein concentric to a common central longitudinal axis. A housing of the adjusting unit is supported radially in the tube and is guided for displacement in the direction of the axis. A piston rod is affixed on a base plate of the tube against movement in the direction of the axis and is supported for rotation with respect to the base plate by means of an axial rolling bearing preassembled into a unit. U.S. Pat. No. 5,120,011 also describes and shows a longitudinally displaceable column.

The purpose of a preassembled bearing unit can be seen in that assembly of the longitudinal adjusting unit is substantially facilitated. Rolling members cannot fall out of the bearing. Despite this, the bearing unit has the disadvantage of relatively high costs, which it is the object of the invention to minimize.

SUMMARY OF THE INVENTION

According to the present invention, the above-mentioned object is accomplished in that the axial bearing is a sliding bearing having a sliding member. The sliding member of a sliding bearing does not involve the high production cost of a rolling bearing. The disadvantage that a rolling bearing may disassemble into its component parts on assembly is avoided. The materials available for sliding members, synthetic materials in particular, have a very favorable coefficient of friction, so that no functional disadvantages need be feared. The sliding member is annular so as to have a pass-through opening for receiving the rod of the longitudinal adjusting unit.

In addition, it is provided, preferably, that the sliding bearing have a supporting disk, the rod of the longitudinal adjusting unit being supported on the supporting disk. A pneumatic unit whose piston rod has a comparatively small diameter, where the supporting surface of the piston rod is formed by a shoulder on the rod, is very often used as the longitudinal adjusting unit. Consequently, great surface pressures may occur, which are exerted on the supporting disk, which is preferably of a metallic or ceramic material, and transmitted to the sliding member. The outside diameter of the supporting disk is significantly greater than the diameter of the piston rod, so that the surface pressure on the sliding member is reduced.

So that the sliding member will under no circumstances detach from the rod after assembly, the rod has an annular groove in which locking projections of the slide member are engaged and form a locking connection. A locking connection is subject to less friction than a frictionally engaged connection.

For easier assembly the sliding member has free spaces that provide for radial expansion of the locking projections.

The locking projections are arranged in the region of the pass-through opening and do not project over the end surfaces of the sliding member, so that both end surfaces are available as supporting surfaces.

With regard to increased reliability of assembly, the locking projections have bevels tapering outwardly in the direction of assembly of the sliding member onto the rod, which convert axial motion of the sliding member in the direction of assembly into radially outward motions of the locking projections. In the event of assembly of the sliding member in the wrong direction, faces of the locking projections encounter the piston rod and make further assembly at least difficult due to a large resistance force at the faces.

It is advantageously provided that the depth of the free spaces in the axial direction is greater than the height of the locking projections. The free spaces thus allow the sliding member to be deformed within limits, in order to compensate for any possible skewed position of the rod with respect to the end surface of the sliding member.

With regard to a fixed installation position that ensures against incorrect assembly of the sliding bearing on the rod, the sliding member has a peripheral flange portion, an end part of which is offset axially in the direction of a shoulder of the rod. Thus, in the event of an incorrect installation position, an installation height increased by the shoulder is produced for the rod, so that a securing arrangement on the rod for fastening the longitudinal adjusting unit within the tube cannot be installed.

For securing the supporting disk in the radial direction, the peripheral flange portion of the sliding member forms a recess and centers the supporting disk within the recess. In addition, the supporting disk is fixed axially to the sliding member by retaining overhangs on the end part of the flange portion of the sliding member.

In order not to overload the peripheral flange portion of the sliding member when the supporting disc is installed in the recess within the flange portion, the retaining overhangs are in the form of segments around the periphery. Lastly, the flange portion has spaced-apart recesses which increase its elasticity.

DESCRIPTION OF THE DRAWINGS

Further objects, features and advantages of the invention will become apparent from the following description of an exemplary embodiment, taken in conjunction with the accompanying drawing figures in which.

FIG: 1 is a generally schematic side cross-sectional view of the embodiment.

DESCRIPTION OF THE EMBODIMENT

Figure 1:
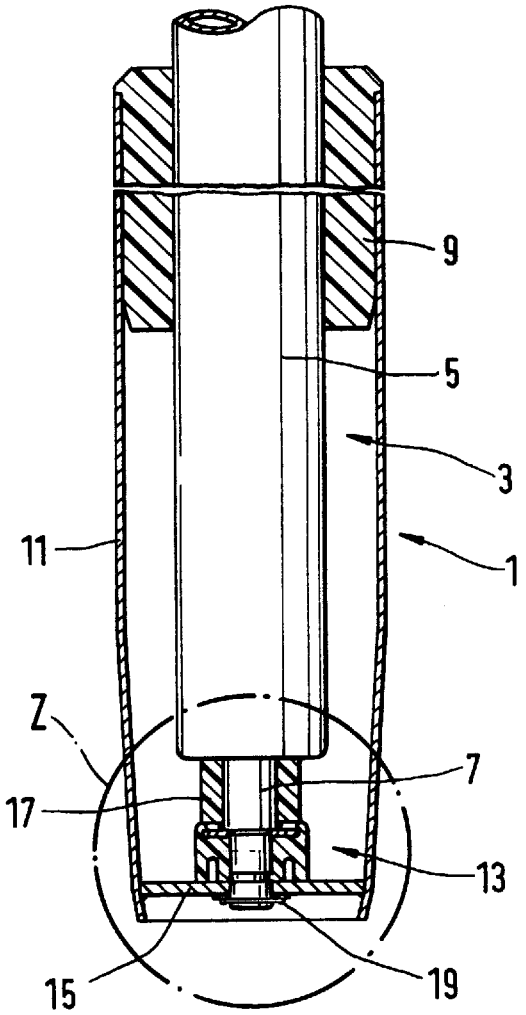

FIG. 1 shows a longitudinally displaceable column 1 for height adjustment of tables, chairs or the like. The longitudinally displaceable column includes a longitudinal adjusting unit 3, which has a cylinder 5 with an axially movable piston rod 7. A pneumatic, a hydropneumatic, or a mechanical adjusting unit—examples of adjusting units are disclosed in, for example, DE Geb 76 23 283 and WO 96/03065—may be used as the longitudinal adjusting unit. A guide bushing 9 centers and guides the cylinder 5 within a vertical tube 11.

The piston rod 7 is capable of rotating relative to the tube 11 by way of an axial bearing 13, but is fastened axially relative to the tube by way of a base plate 15. A buffer 17 may optionally be provided as a bottom stop. The base plate 15 represents a supporting surface for the axial bearing 13, while the end of the piston rod penetrates the base plate and has an axial fastener 19 that consists of a washer and a retaining ring.

Figure 2:
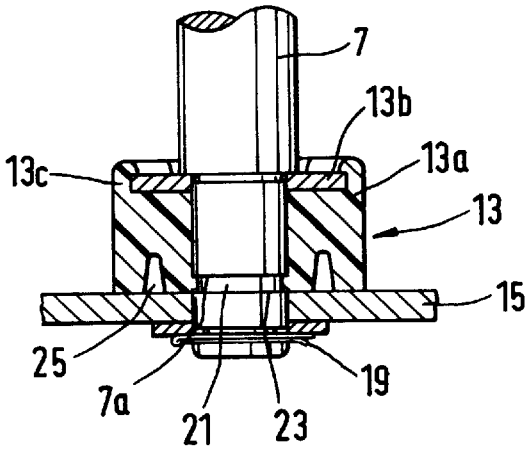
FIG. 2 is a fragmentary side cross-sectional view of the lower portion of the embodiment on a larger scale, as indica d by the circle in FIG. 1.
Figure 6:
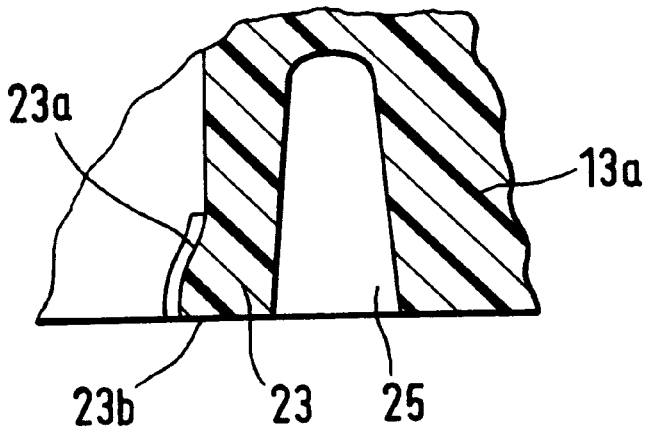
FIG. 6 is a fragmentary side cross-sectional view of a lower part of the sliding member.
Figure 7:
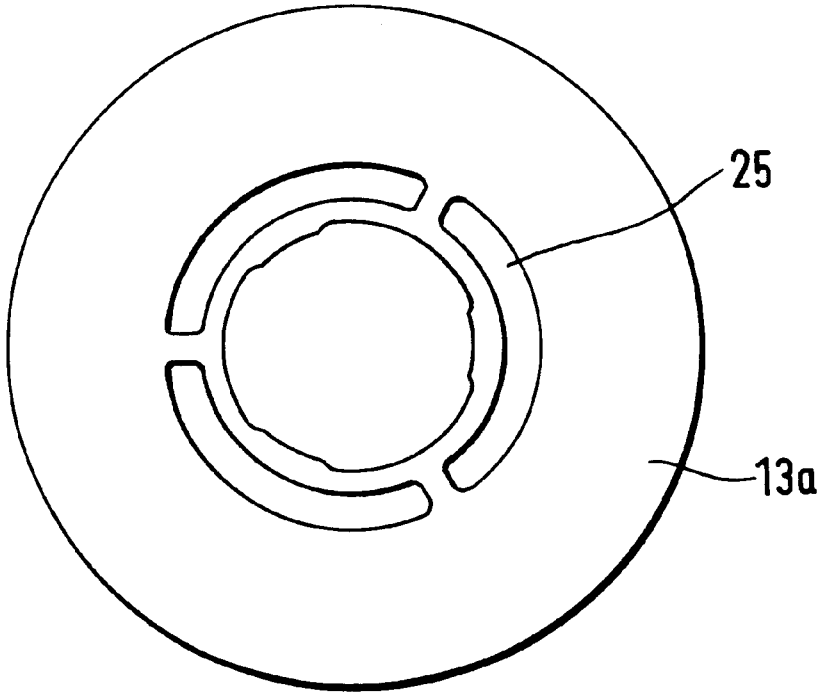
FIG. 7 is a bottom plan view of the sliding member.

FIG. 2 shows the part of the longitudinally displaceable column in the region of the axial bearing 13. The axial bearing is a sliding bearing and consists of a sliding member 13*a* and a supporting disk 13*b*. The sliding member is ring-shaped with a pass-through opening for the piston rod 7 and consists of a low-friction material, for example a synthetic material. A bottom end surface of the sliding member is supported on the base plate 15. An annular groove 21 is formed in the piston rod 7. Locking projections 23 on the sliding member are received in the groove 21 and fix the sliding member to the rod axially in both directions. So that the projections can be deformed radially outwardly, in order to allow the sliding member to be slid onto the piston rod, free spaces 25 are provided at least at intervals in the peripheral direction (see FIG. 6). The free spaces have a depth in the axial direction of the sliding member that is greater than the height of the projections (see FIG. 7).

Figure 3:
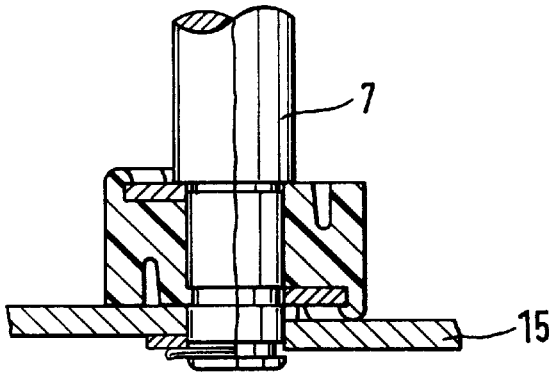
FIG. 3 is a diagrammatic partial side crosssectional view of the portion shown in FIG. 2, the left half showing the slide bearing in the correctly assembled position and the right half showing the slide bearing upside down, a position in which assembly cannot be completed.
Figure 4:
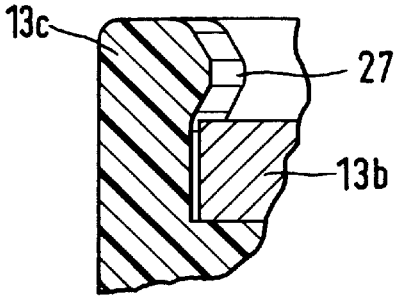
FIG. 4 is a fragmentary side cross-sectional view of an upper perimeter part of the embodiment.

In the assembled state the annular groove 21 in the piston rod 7 is located close to the upper surface of the base plate 15, as shown in FIG. 2 and the left half of FIG. 3. As FIG. 3 shows, this results in a fixed or single installation position of the slide bearing in which the projections 23 are received in the groove 21 of the piston rod and the fastening arrangement 19 is assembled on the lower end of the piston rod under the base plate 15. If a worker attempts to install the slide bearing on the piston rod in an inverted position of the slide bearing, as shown in the right half of FIG. 3, the upper part of the flange portion 13*c*, which in the correct position lies above the shoulder of the piston rod, bears against the upper surface of the base plate 15, increases the distance between the shoulder on the piston rod and the upper surface of the base plate, as compared to the correct installation orientation and prevents the lower end of the piston rod from protruding far enough below the base plate 15 to allow installation of the fastening arrangement 19. In addition, the projections 23 are provided with formed bevels 23*a* (see FIG. 6) which, in the correct assembly position, aid in radially expanding the projections 23 outwardly when the projections engage the lower end of the piston rod when it is slid onto the piston rod. In the opposite direction, i.e., the wrong direction of assembly, the surfaces 23*b* lie perpendicular to the end of the piston rod and impede a radial expansion of the projections 23. As a result, the sliding member, in the inverted condition, can only be slid onto the rod assembled with a markedly excessive application of force, which would immediately be recognized by a worker as an assembly error.

Figure 5:
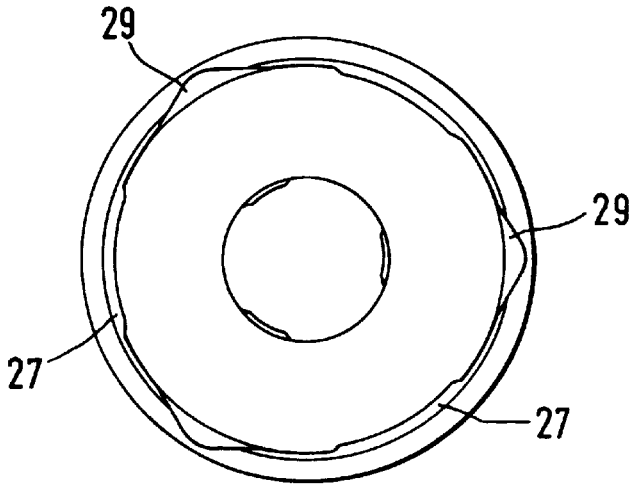
FIG. 5 is a top plan view of the slide bearing.

The supporting disk 13*b* is centered in an upper recess of the sliding member 13*a* formed by the peripheral flange portion 13*c*. The disk 13*b* is intended to reduce the surface pressure acting on the sliding member. The flange portion 13*c* also has locking function, which is provided by circumferentially spaced apart overhanging portions 27 (see FIG. 5), which hold the supporting disk 13*b* axially in the recess on the upper surface of the sliding member 13*a*. Circumferentially spaced-apart V-shaped recesses 29 located in the flange portion 13*c* between the overhanging portions 27 make the flange portion elastically deformable in order to allow the overhanging portions 27 to expand radially outwardly so that the supporting disk 13*b* can be assembled on the sliding member 13*a*.

What is claimed is:

1. A longitudinally displaceable column comprising a vertical support tube;

a base plate affixed to the support tube adjacent a lower end thereof; and a longitudinal adjusting unit having a rod supported at a lower end thereof on the base plate by an axial bearing so that the rod is rotatable relative to the base plate, the rod including an annular groove adjacent the base plate, the axial bearing being a sliding bearing that includes a sliding member, and the sliding member including locking projections engaged in the groove of the rod and forming a locking connection between the sliding member and the rod against axial movement of the rod relative to the sliding member and free spaces enabling radial expansion of the locking projections, the locking projections including bevels that upon engagement with the piston rod at assembly of the sliding member on the piston rod convert an axial motion of the sliding member in the direction of assembly into the radial expansion of the locking projections, while in the event of assembly of the sliding member in the wrong direction faces of the locking projections engage the piston rod and make further assembly motion at least difficult.

2. The longitudinally displaceable column according to claim 1, wherein the depth of the free spaces in the axial direction is greater than the height of the locking projections.

3. The longitudinally displaceable column according to claim 1, wherein the sliding bearing further includes a supporting disk and the rod of the longitudinal adjusting unit is supported on the supporting disk.

4. The longitudinally displaceable column according to claim 3, wherein the sliding member includes retaining structure affixing the supporting disk on an upper surface of the sliding member against radial and axial displacements.

5. The longitudinally displaceable column according to claim 4, wherein the retaining structure is a peripheral flange portion which forms an upper recess in the sliding member, the supporting disk is received in the recess and retained radially by the flange portion, the supporting disk is engaged by a shoulder on the rod, and overhangs on an upper part of the flange portion retain the supporting disk axially.

6. The longitudinally displaceable column according to claim 5, wherein the flange portion centers the supporting disk on the sliding member.

7. The longitudinally displaceable column according to claim 5, wherein the overhangs are segments spaced apart in the circumferential direction.

8. The longitudinally displaceable column according to claim 5, wherein the flange portion has recesses which increase the elasticity of the flange portion.

9. A longitudinally displaceable column comprising a vertical support tube;

a base plate affixed to the support tube adjacent a lower end thereof; and a longitudinal adjusting unit having a rod supported at a lower end thereof on the base plate by an axial bearing so that the rod is rotatable relative to the base plate, the rod including an annular groove adjacent the base plate, the axial bearing being a sliding bearing that includes a sliding member, the sliding member including locking projections engaged in the groove of the rod and forming a locking connection between the sliding member and the rod against axial movement of the rod relative to the sliding member and free spaces enabling radial expansion of the locking projections, the sliding bearing further including a supporting disk that supports the rod of the longitudinal adjusting unit, and the supporting disk being engaged by a shoulder on the rod, a peripheral flange portion that forms an upper recess in the sliding member in which the supporting disk is received and retained radially and includes overhangs on an upper part of the flange portion retaining the supporting disk axially, and the flange portion having recesses which increase the elasticity of the flange portion.

10. The longitudinally displaceable column according to claim 9, wherein the locking projections include bevels that upon engagement with the piston rod at assembly of the sliding member on the piston rod convert an axial motion of the sliding member in the direction of assembly into the radial expansion of the locking projections, while in the event of assembly of the sliding member in the wrong direction faces of the locking projections engage the piston rod and make further assembly motion at least difficult.

11. The longitudinally displaceable column according to claim 9, wherein the depth of the free spaces in the axial direction is greater than the height of the locking projections.

12. The longitudinally displaceable column according to claim 9 wherein the flange portion centers the supporting disk on the sliding member.

13. The longitudinally displaceable column according to claim 9, wherein the overhangs are segments spaced apart in the circumferential direction.

* * * * *